US006004074A

United States Patent [19]

Shanks, II

[11] Patent Number: 6,004,074

[45] Date of Patent: Dec. 21, 1999

[54] MARINE RISER HAVING VARIABLE BUOYANCY

[75] Inventor: Forrest Earl Shanks, II, DeSoto, Tex.

[73] Assignee: Mobil Oil Corporation, Fairfax, Va.

[21] Appl. No.: 09/132,641

[22] Filed: Aug. 11, 1998

[51] Int. Cl.[6] ..... E02B 11/38

[52] U.S. Cl. ..... 405/195.1; 405/224; 405/224.2; 166/350; 166/367

[58] Field of Search ..... 405/195.1, 200, 405/224, 224.1, 224.2, 224.3, 224.4, 225; 166/350, 355, 359, 367; 521/56, 60; 114/331

[56] References Cited

U.S. PATENT DOCUMENTS

| | | | |
|---|---|---|---|
| 1,772,709 | 8/1930 | Culbertson . | |
| 3,195,493 | 7/1965 | Lacam et al. | 114/331 |
| 3,605,670 | 9/1971 | Dzikowski | 114/331 |
| 3,705,432 | 12/1972 | Watkins . | |
| 3,729,756 | 5/1973 | Cook et al. . | |
| 3,782,458 | 1/1974 | Slack | 166/359 X |
| 3,855,803 | 12/1974 | Lacroix | 405/206 |
| 3,858,401 | 1/1975 | Watkins | 405/224.2 |
| 3,881,439 | 5/1975 | Svanholm . | |
| 3,952,526 | 4/1976 | Watkins et al. | 405/224.2 |
| 3,992,889 | 11/1976 | Watkins et al. | 405/224.2 |
| 4,021,589 | 5/1977 | Copley | 428/68 |
| 4,049,604 | 9/1977 | Morehouse, Jr. et al. | 428/500 X |
| 4,099,560 | 7/1978 | Fischer et al. | 166/350 |
| 4,102,142 | 7/1978 | Lee . | |
| 4,116,009 | 9/1978 | Daubin | 405/195.1 X |
| 4,176,986 | 12/1979 | Taft et al. . | |
| 4,422,801 | 12/1983 | Hale et al. | 405/171 |
| 4,474,129 | 10/1984 | Watkins et al. | 114/243 |
| 4,477,207 | 10/1984 | Johnson . | |
| 4,545,437 | 10/1985 | Denison | 166/355 X |
| 4,598,106 | 7/1986 | Utsugi | 521/54 X |
| 4,616,707 | 10/1986 | Langner | 166/367 X |
| 4,617,998 | 10/1986 | Langner | 166/367 X |
| 4,636,114 | 1/1987 | Hale . | |
| 4,646,840 | 3/1987 | Bartholomew et al. . | |
| 4,768,455 | 9/1988 | Maxson et al. | 405/224 X |
| 5,046,896 | 9/1991 | Cole . | |
| 5,657,823 | 8/1997 | Kogure et al. . | |
| 5,660,233 | 8/1997 | Sparks . | |
| 5,706,897 | 1/1998 | Horton . | |

FOREIGN PATENT DOCUMENTS

| | | | |
|---|---|---|---|
| 2178090 | 2/1987 | United Kingdom | 166/367 |

*Primary Examiner*—David Bagnell
*Assistant Examiner*—Jong-Suk Lee
*Attorney, Agent, or Firm*—Robert B. Furr, Jr.; Malcolm D. Keen

[57] ABSTRACT

A variable-buoyancy marine riser and a method for providing and adjusting the buoyancy for such a riser. The riser is comprised of a main riser conduit on which a plurality of cans are affixed. A slurry of buoyant material, e.g. small, hollow spheres, is pumped into the cans to displace the seawater therein and give buoyancy to the riser. When it is desired to reduce the buoyancy of the riser, the spheres are removed by merely opening the cans and allowing the surrounding seawater to displace the spheres from the cans.

19 Claims, 3 Drawing Sheets

MARINE RISER HAVING VARIABLE BUOYANCY

DESCRIPTION

1. Technical Field

The present invention relates to a marine riser having variable buoyancy and in one aspect relates to marine riser and a method for varying the buoyancy thereof by pumping/evacuating a slurry of hollow, buoyant spheres into/from one or more "cans" which are connected to and spaced along at least a portion of the riser.

2. Background

A major component in the drilling of any offshore well from a floating vessel is the "drilling riser" which fluidly connects the floating vessel to the drilling wellhead on the marine bottom. A typical drilling riser is comprised of a string of relatively large-diameter casing which is suspended from the vessel at its upper end and is secured to the submerged wellhead at its lower end through a flexible connection (e.g. a ball-joint connection or the like). During drilling, the riser guides the drill string down through the water body and into the wellhead and provides a passage for the drilling "mud" and entrained cuttings back to the surface of the water.

As will be understood in the art, a drilling riser must be effectively maintained in tension at all times during a floating drilling operation. This is necessary to prevent buckling or other stress failures from occurring in the riser as the floating vessel heaves on the water surface, especially when the vessel heaves heavily downward. To keep the riser in constant tension, tensioning mechanisms (i.e. heave compensators) are located on the vessel and apply a continuous, upward force on the upper end of the riser.

However, as floating drilling operations move into deeper and deeper waters, it becomes impractical to build heave compensators of the size needed to handle the lengths (i.e. weight) of the drilling riser required for such drilling operations. Accordingly, in order to use standard types of heave compensators in deep-water drilling operations, it is now common to reduce the effective (i.e. in-water) weight of the riser by adding buoyancy to the riser. This is typically done by attaching buoyancy elements (e.g. blocks of syntactic foam, "air cans", or combinations of both) along at least a portion of the riser.

As will be understood in the art, the buoyancy of elements made of syntactic foam can be increase by embedding small, hollow glass or plastic spheres therein. However, the use of syntactic foam has certain drawbacks, one being the buoyancy of the riser is "fixed" once the foam blocks are in place and can not be readily changed or adjusted after the riser is installed.

Accordingly, air cans are now widely-used to provide the necessary buoyancy for deep-water risers since the buoyancy of the riser can be adjusted after the riser has been installed; for example see U.S. Pat. Nos. 4,102,142; 4,176,986; 4,422,901; 4,636,114; 4,646,840; 5,657,823; and 5,706,897. In a typical riser of this type, a plurality of cans (i.e. air-tight enclosures) which can be flooded with seawater are connected onto the riser at spaced points along at least a portion of its length. To provide buoyancy to the riser, air is flowed under pressure into the lowermost can to displace the water thereby making that can buoyant. Once the water has been forced from the lowermost can, the flow of air is then directed to the next higher can, and so forth until all of the desired cans have been evacuated and are filled with air.

As will be understood, the actual amount of buoyancy desired for a particular drilling riser will depend on the conditions which are expected during a particular drilling operation; (i.e. length/weight of the riser, typical heave of the vessel, etc.). With this information, the size, number, and location of cans can be determined and installed onto the riser.

Ideally, when a properly-designed riser is installed and all cans are evacuated and filled with air, the riser will have its desired buoyancy, i.e. the "in-water" weight of the riser is reduced wherein standard-type, mechanical/hydraulic tensioners on the vessel can readily maintain the riser in tension even during severe downward heave of the vessel, especially when the riser is disconnected from the marine bottom.

That is, due the reduced, effective weight of the riser, the downward acceleration of the riser when the lower end of the riser is disconnected will be equal to or less than the downward acceleration of the vessel when the vessel heaves thereby allowing the riser to remain in tension during sudden downward movement of the vessel. This prevents severe buckling and/or failure of the riser, especially in heavy weather conditions. Further, the buoyancy added by the air cans aids in maintaining the riser within an acceptable drilling angle between the vessel and the wellhead (i.e. within 2° or less as measured from vertical).

As pointed out above, air cans allow the buoyancy of the riser to be adjusted when required during the drilling operation. For example, the cans can be flooded with water to increase the effective weight of the riser if and when it becomes necessary to disconnect the bottom of the riser from the submerged, drilling wellhead. If there is time for a "planned disconnect" (e.g. for maintenance in calm seas; sufficient advance warning of a storm; etc.), the buoyancy of the riser can be orderly adjusted wherein all of the cans may not have to be flooded with water before the riser is disconnected. This allows the riser to be reconnected when desired without having to pump air back into all of the cans which, in turn, which requires substantial compressor horsepower and is time consuming and hence, expensive.

However, in the case of an emergency disconnect (i.e. loss of the thrusters on the vessel, a sudden storm, etc.), all of the cans may have to be flooded at once to quickly increase the effective, in-water weight of the riser. This is necessary to insure that the riser will remain in tension while suspended below the vessel after it has been disconnected from the marine bottom. If a riser retains too much of its buoyancy, such as a fixed-buoyant riser using foam, it can be severely damaged by the currents, etc., once disconnected and, in some instances, cause damage to the vessel, itself.

As described above, air and/or inert gas is typically used to displace water from the cans to thereby adjust the buoyancy of a marine riser. Unfortunately, however, the use of air/gas for this purpose has certain drawbacks, especially as floating drilling operations move into deeper waters. That is, air cans are typically positioned along the lower portion of the riser thereby placing some of them at great depths at which the water pressures are substantial. Accordingly, the air or other gas has to be compressed to very high pressures in order to displace the water from these cans which, in turn, can requires significant amounts of compressor-horsepower. As will be recognized by those skilled in this art, not only are such compressor expensive to acquire and maintain but they require a substantial amount of valuable space aboard the vessel.

Further, the response time for charging the cans of a deep-water riser with air can be considerable thereby substantially increasing the costs of the already expensive drilling operation especially during both during the initial installation of the riser and during any required re-connections operations. Still further, if an air can springs a leak, the air will bleed out and the can will fill with water thereby causing an unwanted decrease in the buoyancy of the riser during the drilling operation.

SUMMARY OF THE INVENTION

The present invention provides a variable-buoyancy marine riser and a method for providing and adjusting the buoyancy for such a riser. Basically, the riser is comprised of a main riser conduit on which a plurality of cans are affixed. A slurry of buoyant material, e.g. small, hollow spheres, is pumped into the cans to displace the seawater therein and give buoyancy to the riser. When it is desired to reduce the buoyancy of the riser, the spheres are removed by merely opening the cans and allowing the surrounding seawater to displace the spheres from the cans. By using buoyant, particulate solids such as hollow spheres instead of compressed air for providing the variable-buoyancy for the riser, pumps can be used to place the spheres thereby eliminating the need for the expensive compressors previously required where air is used.

More specifically, the present invention provides a variable-buoyant marine riser which is comprised of a main riser conduit which is adapted to extend from the surface of a body of water to a wellhead on the marine bottom and which has at least one canister or "can" affixed thereto. Preferably, there are a plurality of cans spaced along the lower 25% of the main riser conduit. Each can comprising is comprised of a housing which is closed at its top and which has an open bottom which, in turn, is covered by a fluid-permeable material (e.g. fine-mesh screen) for allowing flow of fluids (e.g. seawater) into and out of the cans while blocking the flow of solid materials. A fill line extends from the surface and terminates within the uppermost can near the lower end thereof and a return line extends from the surface and terminates within the uppermost can near the upper end thereof.

Particulate buoyant material, e.g. small hollow spheres or buoyant beads, or MICRO-BALLOONS 30 or similar buoyant material (hereinafter collectively called "spheres") is mixed with a liquid (e.g. seawater) to form a slurry which is flowed down the fill line into the uppermost one can after said marine riser has been installed at an offshore location. The spheres accumulate within the one can thereby forcing the seawater from the can through the screen to provide buoyancy for said marine riser. When required, the buoyancy of the riser is adjusted by removing at least some of the buoyant spheres through the return line.

In one embodiment of the present invention, a valve assembly is provided within each can so that each can can be isolated from the others after a can has been substantially filled with the buoyant material while in another embodiment the fill line and said return line is a single line which extends from the surface to each of the cans. Individual, remotely-controlled valves allow each can to be filled with or emptied of buoyant material independently of the others.

BRIEF DESCRIPTION OF THE DRAWINGS

The actual construction operation, and apparent advantages of the present invention will be better understood by referring to the drawings, not necessarily to scale, in which like numerals identify like parts and in which.

BEST KNOWN MODE FOR CARRYING OUT THE INVENTION

Figure 1:
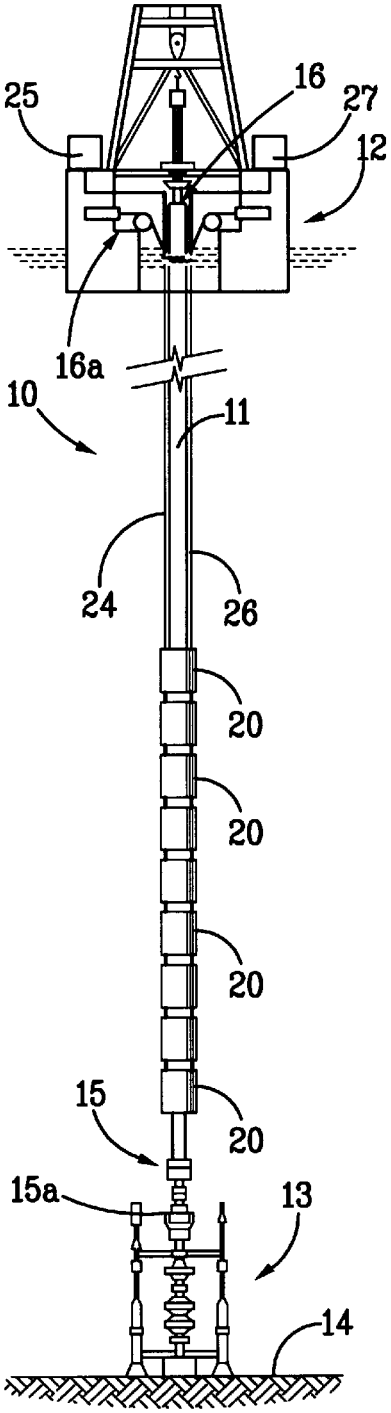
FIG. 1 is a perspective view, partly in section, of the variable-buoyancy, riser of the present invention suspended in an operable position from a floating vessel.

Referring more particularly to the drawings, FIG. 1 illustrates the variable-buoyancy, marine riser system 10 of the present invention when installed in an operable position at an offshore drilling site. Marine riser system 10 is comprised of a main riser conduit 11, typically formed from relatively, large-diameter casing (e.g. 18.5 to 21 inch), which extends from floating vessel 12 to submerged, drilling wellhead 13 which, in turn, is positioned on the marine bottom 14.

As will be understood in the offshore drilling art, the lower end of the main conduit 11 is connected to wellhead 13 via a releasable connection 15 and has a ball-joint 15*a* or the like therein to allow the riser to incline slightly from vertical during drilling. The upper end of main conduit 11 is suspended from vessel 11 by a slip-joint arrangement 16 and is maintained in tension by typical, known mechanical/hydraulic tensioners 16*a* so that vessel 11 can heave up and down without buckling the riser.

To provide buoyancy to riser system 10, at least one canister or "can" 20 and preferably a plurality of cans (only some numbered in FIG. 1 for clarity) are connected to and are spaced along at least a portion of main conduit 11 (e.g. along about 25% of the lower length of conduit 11). The buoyancy provided by cans 20 lower the effective weight of the riser thereby requiring less upward force from tensioners 16*a* to keep the riser in tension. More importantly, the downward acceleration of the riser will be equal to or less than that of the vessel which, in turn, allows the riser to remain in tension during sudden, downward movement of the vessel thereby preventing buckling or other serious damage to the riser during drilling.

Each can 20 is substantially identical to each of the other cans and may be constructed of any appropriate suitable (e.g.. aluminum, steel, plastics, etc.) which has the required strength to withstand the maximum pressures expected during a particular drilling operation. Cans 20 may be of unitary construction (e.g.. see U.S. Pat. No. 4,636,114 and 4,646,840) or they can be made in sections which are then assembled around the main riser conduit 11 (see U.S. Pat. No. 4,422,801).

Figure 2:
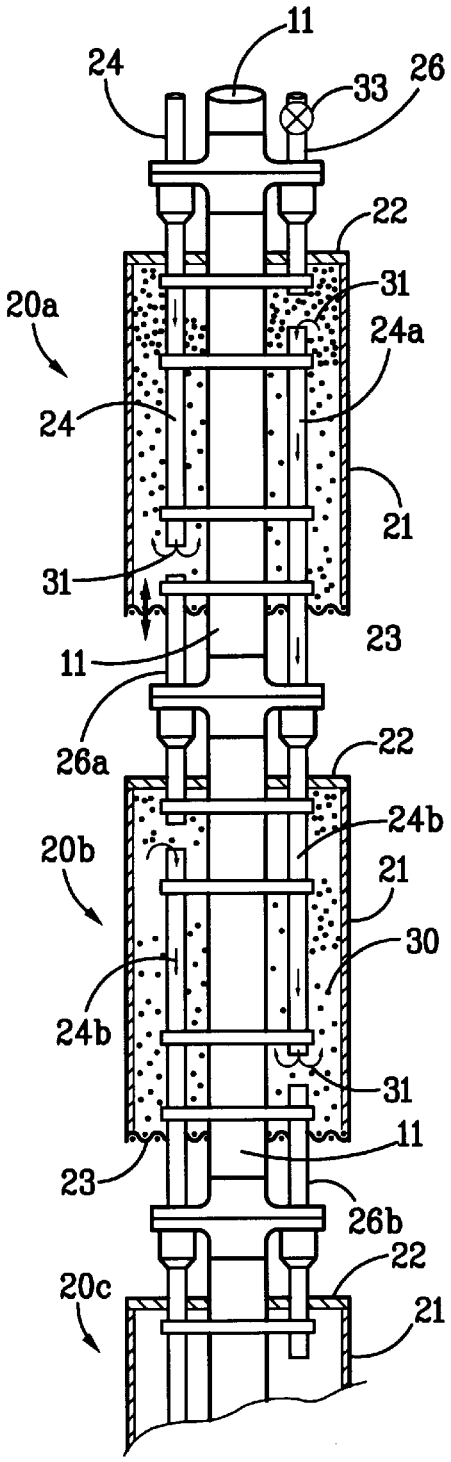
FIG. 2 is an enlarged, elevational view, partly in section, of the buoyancy canisters or "cans" of the type mounted on the riser of FIG. 1 as they are being filled with buoyant, hollow spheres in accordance with the present invention.

Referring now to FIG. 2, can 20 is illustrated as being comprised of a cylindrical housing 21 which is closed at its top by a cover 22 or the like which, in turn, is secured or affixed to main conduit 11 by welding or the like. The lower end of housing 21 is open and is covered by a water-permeable material, e.g. an extremely fine-meshed, screen 23, which allows seawater to flow into and out of can 20 while preventing flow of solid materials therethrough, the purpose of which will become obvious from the following description. Fill line 24 extends from a pump 25 on vessel 11 down along main conduit 11 and terminates within the uppermost can 20*a* near the bottom thereof. Return line 26 extends upward along main conduit 11 from just inside the top of uppermost can 20*a* to a reservoir 27 or the like which is positioned on vessel 11.

In accordance with the present invention, a slurry of particulate buoyant material, e.g. small hollow spheres or buoyant beads, or MICRO-BALLOONS 30 or similar buoyant material (hereinafter collectively called "spheres") is pumped down fill line 24 to displace the water from cans 20 through screens 23 as will be more fully described below. The spheres 30 can be any type of those small, hollow spheres which are commonly used for adding buoyancy to a particular structure, e.g. those used in foam to increase the buoyancy thereof. Such spheres are commercially-available, e.g. "3M" GLASS BUBBLES, SS/X, Minnesota Mining and Mfg. Co., St. Paul, Minn. The buoyant spheres are mixed with a liquid (e.g.. seawater) to form a pumpable slurry which, in turn, is pumped down fill line 24 into cans 20. By using a pumpable slurry in place of air, no compressors are required on vessel 12 for this purpose thereby substantially reducing the costs involved in placing the buoyant material within the cans. As is well known, it is much easier and cheaper to pump a liquid or a slurry of particulates than to compress and transport a gas such as air.

Referring now to FIG. 2, slurry 31 flows through fill line 24 into the bottom of the uppermost can 20*a*. The buoyant spheres 30 rise by gravity to the top of can 20*a* where they accumulate under cover 22. The liquid from the slurry mixes with the seawater in the can as the spheres 30 separate therefrom and is displaced along with the seawater through screen 23 as the accumulated volume of spheres increase within can 20*a*. As can 20*a* fills with spheres 30, some of slurry 31 will be forced through a first intermediate fill line 24*a* and into the bottom of adjacent, lower can 20*b* where the filling process is repeated within can 20*b*, and then on to can 20*c* through intermediate fill line 24*b*, and so on until all of the cans 20 are substantially filled with spheres 30. During the filling operation, return line 26 will be closed either at the surface or by a valve such as 33.

When it is desired to flood the cans with seawater to decrease the buoyancy of the riser and to increase its effective weight, return line 26 is opened to flow and the buoyancy of spheres 30 causes them to flow upward through the return line 26 to reservoir 27 on vessel 12 from which they can be reused. As spheres 30 flow upward from uppermost can 20*a*, the spheres in the next lower can 20*b* will flow upward through intermediate return line 26*a* and into can 20*a* from which they continue to flow upward to the surface through return line 26. This sequence continues until all of the cans have been substantially emptied of spheres 30 and each is flooded with seawater which flows into the respective cans through screens 23 as the spheres are removed.

Figure 3:
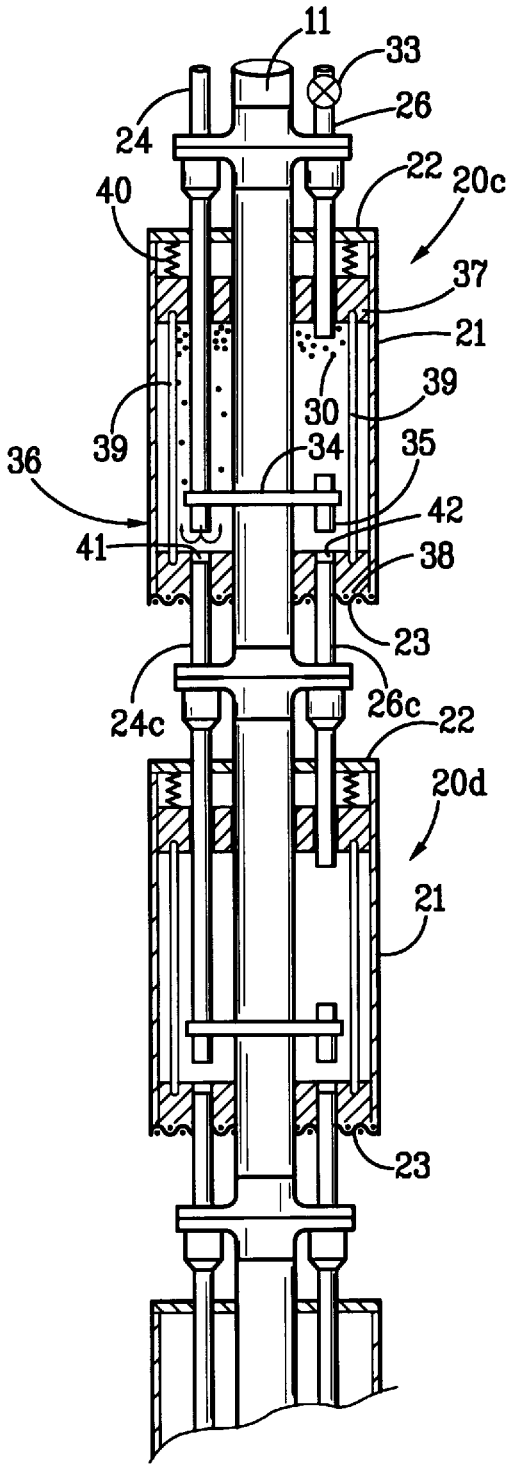
FIG. 3 is an enlarged, elevational view, partly in section, of further embodiment of the buoyancy canisters or "cans" of the type mounted on the riser of FIG. 1 as the cans are being filled with hollow spheres.
Figure 4:
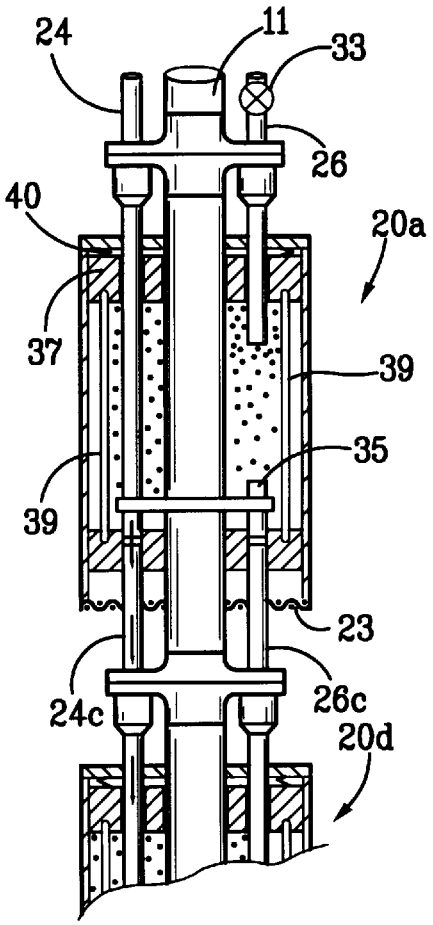
FIG. 4 is an elevational view, partly in section, of the cans of FIG. 3 after they has been filled with hollow spheres.

Referring now to FIGS. 3 and 4, a further embodiment of the present invention is disclosed wherein each of the cans 20 can be isolated from the others. Where the cans are not isolated and are in communication with each other, all of the cans have to be of sufficient strength to withstand the internal pressures exerted by the buoyancy forces being transmitted upward from the lower cans thereby increasing the construction costs of the riser system. However, by isolating each can from the others, an individual can will have to withstand only its own internal pressures.

Cans 20*c*, 20*d* are similar to those in FIG. 2 in that each is comprised of a housing 21 having its top closed by cover 22 and its open bottom covered by screen 23 or the like. Fill line 24 extends from the surface and terminates near the bottom of uppermost can 20*c* while return line 26 extends from the surface and terminates just inside the top of the can 20*c*. A brace member 34 surrounds main riser conduit 11 and is affixed thereto and support the lower end of fill line 24 on one side and carries a plug valve means 35 on the other side for a purpose explained below.

Valve assembly 36 is comprised of an upper annular piston member 37 and a lower annular piston member 38, which are both slidably mounted on main conduit 11. The annular members are spaced from each other by rods 39. Upper piston member 37 has two passages therethrough, one adapted to slidably receive fill line 24 and the other adapted to slidably receive return line 26 while lower piston member has two passages 41, 42 for slidably receiving intermediate fill line 24*c* and intermediate return line 26*c*, respectively, through the lower ends thereof. Valve assembly 36 is normally biased downwardly to a first position within the can (FIG. 3) by spring 40 or the like.

In operation, cans 20*c*, 20*d* are filled with seawater as riser 10 is lowered to the marine bottom. To add buoyancy, a slurry of spheres 30 is pumped down filled line 24 and into the bottom of uppermost can 20*c*. Spheres 30 will migrate upward and will accumulate under the lower surface of upper piston member 37 while the water from the slurry along with the seawater in the can will be forced out of the can through screen 23 as the volume of spheres within the can increase. When can 20*c* becomes substantially filled with spheres 30, the buoyant force of the spheres below upper piston member 37 will cause valve assembly 36 to move upward against the bias of spring 40 to its second position. Flow means (e.g. slight clearance between lines 24, 26 and their respective passages through piston member 37, a separate screened passage through piston 37, or the like) can be provided to allow any water trapped above piston member 37 to escape as the piston member moves upward.

As valve assembly 36 moves upward within can 20*c* to its second position, the lower end of fill line 24 is received into the upper end of passage 41 in lower piston member 38 to thereby establish fluid communication between fill line 24 and intermediate fill line 24*c*. At the same time, plug valve 35 is received into the upper end of passage 42 to block flow therethrough. It can be seen that flow of slurry 31 will now flow through fill lines 24, 24*c* into the lower end of the next lower can 20*d* to repeat the above-described operation. This operation is repeated in sequence until all of the lower cans are filled with spheres 30. However, now as each can is substantially filled with spheres, the respective valve assembly will move upward to isolate each can from the others.

To flood the cans with water, return line 26 is opened and the spheres in uppermost can 20*c* will flow upward therethrough. As the spheres empty from the can, spring 40 will move valve mechanism downward to its first position to open flow through intermediate return line 26*c*. Now the spheres 30 from can 20*d* will flow upward into can 20*c* and on up through return line 26 to the surface. This procedure continues until the desired number of lower can have been emptied of spheres and filled with seawater through respective screens 23.

Figure 5:
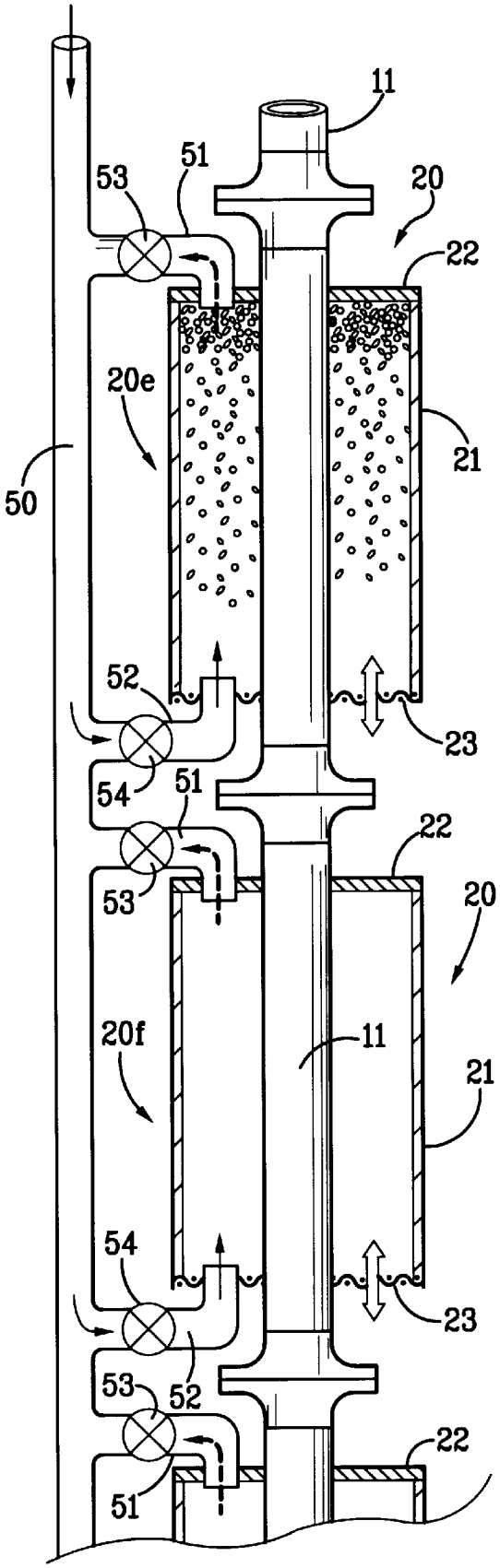
FIG. 5 is an enlarged, elevational view, partly in section, of still another embodiment of the buoyant cans of FIG. 1 wherein each "can" can be filled or emptied independently of the others with hollow, buoyant spheres.

Still another embodiment of the present invention is illustrated in FIG. 5 wherein a selected, individual can 20 can be filled or emptied of spheres. Again, cans 20*e* and 20*f* are of the same basic construction as before in that each is comprised of a housing 21 having its top closed by cover 22 and its open bottom covered by screen 23 or the like. A single fill/return line 50 extends from the surface and is connected to top of each can by a return tube 51 and to the bottom of each can by a fill tube 52. Remotely-operated valves 53, 54 control flow through tubes 51, 52, respectively.

In operation, any can 20 can be selected and its respective valve 54 can be opened. A slurry 31 of spheres is pumped down fill/return line 50 and through the respective fill tube 52 into the bottom of the selected can 20. The filling operation is same as described above in that the spheres 30 will migrate to the top of the can where they accumulate to force the seawater out of the can through screen 23. When a particular can 20 is substantially filled with spheres, valve 54 is closed and the flow of slurry can be directed to another can and so on until all of those desired are filled.

To empty a particular can of spheres and flood it with seawater, its respective valve 53 is opened and the buoyant spheres will flow out of the can through return tube 51 and on to the surface through fill/return line 50. As can be seen, each can 20 can be quickly and easily isolated from the others on the riser. Again, by pumping a slurry of spheres rather than using compressed air to provide the variable buoyancy for a marine riser, the capital and maintenance costs are greatly reduced. Also, the time it takes to add the desired buoyancy to the riser is substantially reduced in that the hollow spheres accumulate displace the seawater from a can at a faster rate than does compressed air.

What is claimed is:

1. A method for providing buoyancy for a marine riser, said method comprising:

affixing at least one can to said marine riser; and flowing a slurry of particulate, buoyant material into said at least one can after said marine riser has been installed at an offshore location wherein said particulate, buoyant material accumulates within said at least one can to provide said buoyancy for said marine riser.

2. The method of claim 1 wherein said buoyancy of said marine riser is adjusted by flowing at least some of said particulate, buoyant material from said at least one can after said particulate, buoyant material has been placed in said at least one can.

3. The method of claim 1 wherein said particulate buoyant material is comprised of hollow spheres.

4. The method of claim 1 wherein said slurry of particulate buoyant material is comprised of hollow spheres and a liquid.

5. The method of claim 4 wherein said liquid is comprised of seawater.

6. The method of claim 4 further comprising:

affixing a plurality of cans to said marine riser; and flowing a slurry of particulate, buoyant material into said cans after said marine riser has been installed at an offshore location wherein said particulate, buoyant material accumulates within said cans to provide said buoyancy for said marine riser.

7. The method of claim 6 wherein said plurality of cans are spaced along about the lower 25 percent of the length of said marine riser.

8. The method of claim 6 including:

flowing said slurry of hollow spheres into a first can of said plurality of cans;

isolating said first can from the other cans of said plurality of cans after said first can has been substantially filled with said hollow spheres;

flowing said slurry of hollow spheres into a second can of said plurality of cans until said second can is substantially filled with said hollow spheres; and isolating said second can from the other cans of said plurality of cans after said second can has been substantially filled with said hollow spheres.

9. The method of claim 8 wherein said first can is the uppermost can on said marine riser.

10. A variable-buoyant marine riser comprising:

a main riser conduit adapted to extend from the surface of a body of water to the marine bottom;

at least one can affixed to said main riser conduit, said can comprising:

a housing having a closed top end and an open bottom end;

a fluid-permeable material covering said bottom end of said housing for allowing flow of fluids therethrough into and out of said at least one can while blocking the flow of solid materials therethrough;

a fill line extending from the surface and terminating within said at least one can near the lower end thereof; said fill line adapted for flowing a slurry of particulate, buoyant material from the surface into said at least one can; and a return line extending from the surface and terminating within said at least one can near the upper end thereof; said return line adapted to flow said particulate, buoyant material from said at least one can to the surface after said particulate buoyant material has been placed within said at least one can.

11. The variable-buoyancy marine riser of claim 10 wherein said buoyant material is comprised of buoyant, hollow spheres.

12. The variable-buoyancy marine riser of claim 11 further comprises:

a plurality of cans spaced along the length of said main riser conduit.

13. The variable-buoyancy marine riser of claim 12 wherein said plurality of cans are spaced along about the lower 25 percent of the length of said main riser conduit.

14. The variable-buoyancy marine riser of claim 12 including:

means for isolating each of said plurality of cans from the other of said cans.

15. The variable-buoyancy marine riser of 12 wherein said fill line and said return line is a single line.

16. The variable-buoyancy marine riser of claim 11 wherein said at least one can comprises:

the uppermost can of a plurality of cans spaced along the length of said main riser conduit.

17. The variable-buoyancy marine riser of claim 16 including:

means for fluidly connecting adjacent cans of said plurality of said cans whereby said slurry of hollow spheres can flow to the next lower can after said uppermost can has been substantially filled with said hollow spheres.

18. The variable-buoyancy marine riser of claim 17 herein said marine riser includes:

an intermediate fill line between said uppermost can and the next lower can of said plurality of said cans;

an intermediate return line between said uppermost can and the next lower can of said plurality of said cans;

and means for isolating said uppermost can from said next lower can, said means comprising:

a valve assembly movable between (a) a first position which allows flow of said slurry into said uppermost can and (b) a second position wherein said flow of slurry is directed into said intermediate fill line and into said next lower can while the flow is blocked through said intermediate return line.

19. The variable-buoyancy marine riser of claim 18 wherein said valve assembly is normally biased towards said first position and is moved to said second position by the buoyant force of said hollow spheres in said uppermost can.

* * * * *